US007388142B2

(12) United States Patent
Daigle

(10) Patent No.: US 7,388,142 B2
(45) Date of Patent: Jun. 17, 2008

(54) FINE TUNING DEVICE ADAPTED FOR USE WITH STRINGED MUSICAL INSTRUMENTS SUCH AS ZITHERS

(76) Inventor: Peter Daigle, P.O. Box 13270, Des Moines, WA (US) 98198

( * ) Notice: Subject to any disclaimer, the term of this patent is extended or adjusted under 35 U.S.C. 154(b) by 765 days.

(21) Appl. No.: 10/839,811

(22) Filed: May 5, 2004

(65) Prior Publication Data

US 2004/0255750 A1 Dec. 23, 2004

Related U.S. Application Data

(60) Provisional application No. 60/478,971, filed on Jun. 17, 2003.

(51) Int. Cl.
*G10D 1/12* (2006.01)

(52) U.S. Cl. ..... 84/285; 84/284

(58) Field of Classification Search ..... 84/284, 84/285, 286, 287, 288, 289
See application file for complete search history.

(56) References Cited

U.S. PATENT DOCUMENTS 257,808 A 5/1882 Zimmerman
459,603 A 9/1891 Tuebnee
973,846 A 10/1910 Bendel
1,390,004 A * 9/1921 Winquist et al. ..... 84/285
4,506,583 A 3/1985 Newton
5,052,259 A * 10/1991 Orthey et al. ..... 84/288
5,767,427 A 6/1998 Corso

* cited by examiner

*Primary Examiner*—Kimberly Lockett
(74) *Attorney, Agent, or Firm*—Thomas E. Loop

(57) ABSTRACT

The invention herein disclosed is, in one embodiment, directed to a stringed musical instrument (e.g., a zither) that comprises a body; a plurality of laterally spaced apart tensioned strings connected to said body; axially spaced apart string supports below the strings, said strings contacting the string supports and having span regions spanning between the string supports; and a presser for each string, each presser in contact with the span region of its string, and each presser being movable laterally to displace the span region of its string and increase the tension in its string, and being movable laterally away from the span region of its string for releasing its string and lessening the tension in its string.

12 Claims, 1 Drawing Sheet

FINE TUNING DEVICE ADAPTED FOR USE WITH STRINGED MUSICAL INSTRUMENTS SUCH AS ZITHERS

CROSS-REFERENCE TO RELATED APPLICATION

This application claims the benefit of priority to U.S. Provisional Application No. 60/478,971 filed Jun. 17, 2003, which application is incorporated herein by reference in its entirety for all purposes.

TECHNICAL FIELD

The present invention relates generally to stringed musical instruments and, more specifically, to stringed musical instruments such as zithers having devices adapted for fine tuning of the strings.

BACKGROUND OF THE INVENTION

As is appreciated by those skilled in the art, a "zither" is a specialized type of corded or stringed musical instrument. More specifically, zithers include any one of several stringed musical instruments that consist of a flat, shallow resonator box (sets horizontally before the performer when in use) overlaid with a multiplicity (e.g., 20 to 40) of strings. The strings nearest the performer when in use run above a fretted fingerboard against which they are stopped by the left hand to provide melody notes; they are plucked by a plectrum worn on the right thumb. At the same time, the right hand fingers pluck an accompaniment on the farther strings, which remain unstopped. The zither is generally placed across the performer's knees or on a table and is capable of playing notes arranged in a series of octaves.

An "autoharp" is generally considered to be a specialized type of zither on which a simple harmony may be obtained by button-controlled dampers (operating in sets) that when depressed leave free the strings of the desired chord. U.S. Pat. No. 257,808 to Zimmerman discloses the original autoharp. More specifically, U.S. Pat. No. 257,808 teaches a musical instrument having a multiplicity of strings arranged in a number of octaves over a resonating box, wherein a series of chord bars are provided together with a series of dampening pads which engage selected strings when the chord bar is depressed. Thus, only certain of the strings are free to vibrate or give sound when strummed or picked. Further, the dampening is generally selected such that when a particular chord bar is depressed only those selected strings which constitute the notes in that chord are free to vibrate.

In general, zithers are tuned by adjusting the tension of one or more of the strings by use of "tuning pins" attached at one end of the resonator box and to each of the strings. In this regard, the tension of each string may be adjusted by simply turning (tightening or loosening) the tuning pin attached to each string. In this way, each string may be appropriately tensioned so as to vibrate, when strummed or plucked, at a desired and user selected frequency. A problem with tuning pins, however, is that they are often difficult to precisely turn, meaning that it is often difficult to precisely adjust the tension of each string. Put simply, the turning of tuning pins is a somewhat inexact method and practice of tuning a zither or other like musical instrument because the tension of each string is not precisely controlled.

Accordingly, there is a need in the art for new and improved devices and methods for tuning of stringed musical instruments, especially with respect to the fine tuning of zithers or other like musical instruments. The present invention fulfills these needs and provides for further related advantages.

SUMMARY OF THE INVENTION

In brief, the present invention in an embodiment is directed to a stringed musical instrument (e.g., a zither) comprising a body, a plurality of laterally spaced apart tensioned strings connected to said body; axially spaced apart string supports below the strings, said strings contacting the string supports and having span regions spanning between the string supports; and a presser for each string, each presser in contact with the span region of its string, and each presser being movable laterally to displace the span region of its string and increase the tension in its string, and being movable laterally away from the span region of its string for releasing its string and lessening the tension in its string. The body of the musical instrument may be a hollow resonator box having a top side, a first end and a second end, wherein the first end has connected thereto a plurality of tuning pins that are, in turn, connected to the plurality of laterally spaced apart tensioned strings, and wherein the second end has attached thereto the axially spaced apart string supports.

Each presser in this embodiment may be an adjustable screw having a smooth end and an adjusting end, wherein the smooth end contacts the span region of its string, and wherein the adjusting end is adapted to engage a tool (e.g., an allen wrench) for screwing the screw such that the screw is (i) movable laterally to displace the span region of its string and increase the tension in its string, and (ii) movable laterally away from the span region of its string for releasing its string and lessening the tension in its string. In this way, the musical instrument is capable of producing sounds that extend across four consecutive octaves. The stringed musical instrument may further comprise a plurality of substantially parallel slots positioned along the top wall of the bar, wherein said slots connect to the transverse hollow region and define the string supports.

In another embodiment, the present invention is directed to a fine tuning device connected to a stringed musical instrument such as, for example, a zither. The musical instrument comprises a plurality of laterally spaced apart tensioned strings, a top side, a first end and a second end, wherein the first end has connected thereto a plurality of tuning pins, and wherein the second end has connected thereto the fine tuning device. The plurality of laterally spaced apart tensioned strings are generally positioned above the top side and are attached to the plurality of tuning pins and to the fine tuning device. The fine tuning device may be characterized in that it comprises an elongated bar having opposing side walls connected to a top wall, wherein the opposing side walls and the top wall define a transverse hollow region that runs the length of the bar. A plurality of substantially parallel slots are positioned along the top wall of the bar and connect to the transverse hollow region and receive the tensioned strings, thereby defining opposing string supports at the base of each slot and in contact with the tensioned strings. The opposing string supports are connected by span regions of the tensioned strings; and the bar includes a plurality of screw holes engaged with corresponding threaded screws. The screw holes are positioned above the plurality of tensioned strings such that tightening of one of the screws causes an end of the screw to bear down on and further tension its string, and loosening of the one of screws causes the end of the screw to move away from and loosen tension in its string.

These and other aspects of the present invention will be evident upon reference to the following detailed description and related drawings.

BRIEF DESCRIPTION OF THE DRAWINGS

Like reference numerals are used to designate like parts throughout the several views of the drawings, and.

DETAILED DESCRIPTION OF THE INVENTION

Figure 1:
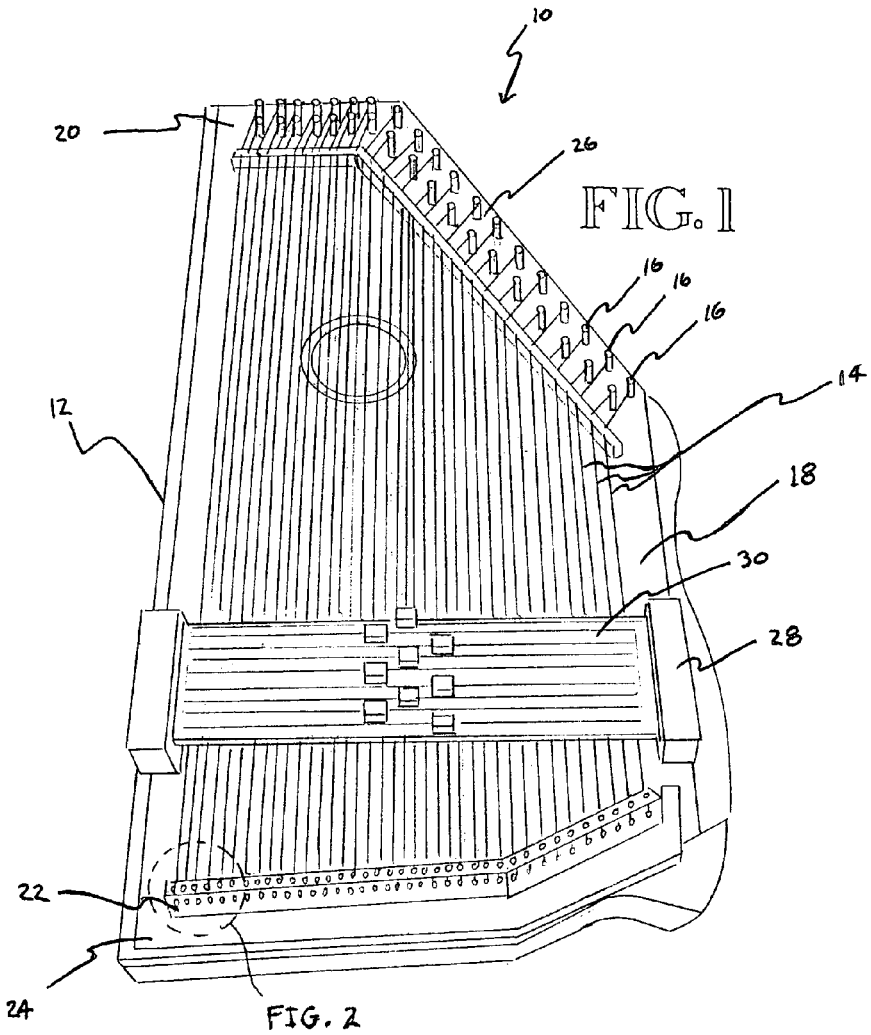
FIG. 1 is a pictorial view of a stringed musical instrument in accordance with an embodiment of the present invention.

The present invention is directed to stringed musical instruments such as zithers having devices adapted for fine tuning of the strings. In some embodiments, the present invention is directed to stringed musical instruments having the tuning devices and support structures described and illustrated herein. Thus, and in order to provide a better understanding of certain embodiments of the present invention, many specific details of such embodiments are set forth in the following description and in FIGS. 1-3. One skilled in the art, however, will understand that the present invention may have additional embodiments and may be practiced without several of the details described below or shown in the accompanying drawings.

Accordingly, and as used herein, the term "zither" means a corded or stringed musical instrument the cords or strings of which are fastened laterally across a frame that lacks any projecting neck or arms, and where the resonator may be part of the body or may be attached to it. Thus, and referring generally to FIG. 1, there is shown a stringed musical instrument 10 (namely, a zither 10) in accordance with an exemplary embodiment of the present invention. As shown, the stringed musical instrument 10 comprises a body 12 that has a plurality of laterally spaced apart tensioned strings 14 connected thereto. The body 12 preferably is a hollow resonator box having approximate dimensions of about 30 cm long, 45 cm wide, and 3 cm deep. The strings 14, which are preferably substantially parallel to and coplanar with one another, are separately connected to (i) a plurality of tuning pins 16 (sometimes referred to as wrest pins) that are attached on a top side 18 and at a first end 20 of the body 12, and (ii) a fine tuning device 22 that is attached at a second end 24 of the body 12.

It is to be understood that the strings 14 may vary not only in diameter, but may also vary in length as is provided by the sloping portion 26 of the musical instrument 10. In addition, the sound produced by each individual string 14 may initially be varied by decreasing or increasing the tension in its string 14 by means of respective tuning pins 16. In this way and in the context of the exemplary zither 10 having thirty-six (36) separate and laterally spaced apart strings as shown (which comprise portions of four separate octaves of the standard notes including sharps and flats), sounds may be produced that extend across four consecutive octaves. Moreover, and to ensure the sounding of only certain strings 14, the exemplary zither 10 preferably further includes a dampening system 28 that includes a plurality of button-controlled dampers 30 for dampening the sound of user selected strings 14.

Figure 3:
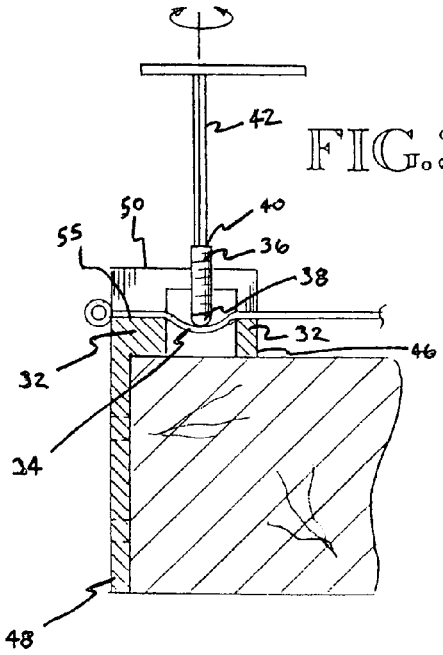
FIG. 3 is a side cross-sectional view of the fine tuning device taken along a line of FIG. 2.
Figure 2:
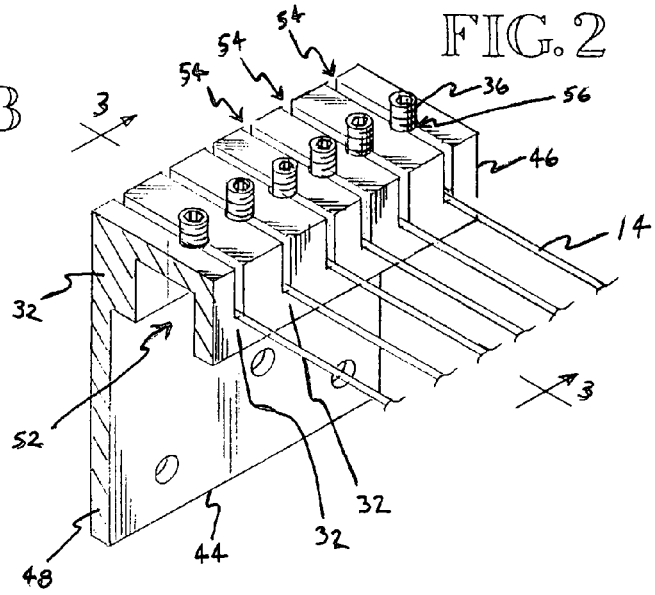
FIG. 2 is an enlarged portion of the stringed musical instrument shown in FIG. 1 detailing a portion of the fine tuning device in accordance with an embodiment of the present invention.

As best shown in FIGS. 2 and 3, the musical instrument 10 further comprises a plurality of axially spaced apart string supports 32 positioned below the laterally spaced apart tensioned strings 14. As shown, the tensioned strings 14 are in contact with the string supports 32 and have span regions 34 that span between the string supports 32. In addition, a presser 36 is provided for each string 14, wherein each presser 36 is in contact with the span region 34 of its string 14. Importantly, each presser 36 is movable laterally so as to displace the span region 34 of its string 14 and increase the tension in its string, and is movable laterally away from the span region of its string for releasing its string and lessening the tension in its string 14. In some embodiments, each presser 36 is an adjustable screw having a smooth end 38 and an adjusting end 40, wherein the smooth end 38 contacts the span region 34 of its string 14, and wherein the adjusting end 40 is adapted to engage a tool 42 (e.g., an allen wrench) for screwing the screw 36 such that the screw 36 is (i) movable laterally to displace the span region 34 of its string 14 and increase the tension in its string 14, and (ii) movable laterally away from the span region 34 of its string 14 for releasing its string 14 and lessening the tension in its string 14. In other embodiments (not shown), alternative span region 34 displacement or presser means may be used such as, for example, a rotatable cam or a movable hook, and are within the scope of the present invention.

The axially spaced apart string supports 32 are preferably contiguous with one another such as when the string supports 32 are made from, as shown, an elongated bar 44 having opposing side walls 46, 48 connected to a top wall 50, wherein the opposing side walls 46, 48 and the top wall 50 define a transverse hollow region 52 that runs the length of the bar 44. In this embodiment, a plurality of substantially parallel slots 54 are positioned along the top wall 50 of the bar 44 and connect to the transverse hollow region 52 and define the string supports 32 at the base of each slot 54. Thus, the axially spaced apart string supports 32 have top surfaces 55 that are flat and substantially coplanar with one another. The bar 44 is preferably an extrusion of a metal such as, for example, aluminum or a rigid plastic material, and may be segmented into one or more pieces. In addition, the bar 44 may further include a plurality of screws holes 56 threadedly engaged together with the screws 36 such that the screws 36 are positioned substantially perpendicular to the strings 14.

Although the stringed musical instruments and fine tuning devices of the present invention have been described in the context of the embodiments illustrated and disclosed herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalents are to be embraced within their scope.

What is claimed is:

1. A stringed musical instrument, comprising:

a body;

a plurality of laterally spaced apart tensioned strings connected to said body;

axially spaced apart string supports below the strings, said axially spaced apart string supports being contiguous with one another and made from an elongated bar having opposing side walls connected to a top wall, wherein the opposing side walls and the top wall define a transverse hollow region that runs the length of the bar, said strings contacting the string supports and having span regions spanning between the string supports; and a presser for each string, each presser in contact with the span region of its string, and each presser being movable laterally to displace the span region of its string and increase the tension in its string, and being movable laterally away from the span region of its string for releasing its string and lessening the tension in its string.

2. The stringed musical instrument of claim 1 wherein the instrument is adapted to produce sounds extending across four consecutive octaves.

3. The stringed musical instrument of claim 1 wherein the instrument is a zither.

4. The stringed musical instrument of claim 1 wherein the body is a hollow resonator box having a top side, a first end and a second end, and wherein the first end has connected thereto a plurality of tuning pins that are connected to the plurality of laterally spaced apart tensioned strings, and wherein the second end has attached thereto the axially spaced apart string supports.

5. The stringed musical instrument of claim 1 wherein the plurality of laterally spaced apart tensioned strings are substantially parallel to one another.

6. The stringed musical instrument of claim 1 wherein the axially spaced apart string supports have top surfaces in contact with the strings, and wherein the top surfaces are flat and substantially coplanar with one another.

7. The stringed musical instrument of claim 1 wherein the plurality of laterally spaced apart tensioned strings are substantially coplanar with one another.

8. The stringed musical instrument of claim 7 wherein the top surfaces of the axially spaced apart string supports are substantially coplanar with the plurality of laterally spaced apart tensioned strings.

9. The stringed musical instrument of claim 1, further comprising a plurality of substantially parallel slots positioned along the top wall of the bar, said slots connecting to the transverse hollow region and defining the string supports.

10. The stringed musical instrument of claim 9 wherein the bar is an extrusion of a metal or a rigid plastic material.

11. The stringed musical instrument of claim 10 wherein each presser is an adjustable screw having a smooth end and an adjusting end, wherein the smooth end contacts the span region of its string, and wherein the adjusting end is adapted to engage a tool for screwing the screw such that the screw is (i) movable laterally to displace the span region of its string and increase the tension in its string, and (ii) movable laterally away from the span region of its string for releasing its string and lessening the tension in its string.

12. The stringed musical instrument of claim 11, further comprising a plurality of screw holes connected to the slots, wherein the plurality of screw holes are threadedly engage the screws and are positioned substantially perpendicular to the strings.

* * * * *